US006655241B2

(12) United States Patent
Kozak

(10) Patent No.: US 6,655,241 B2
(45) Date of Patent: Dec. 2, 2003

(54) ANTI-SKIP FASTENER TIGHTENING AND/OR EXTRACTION DEVICE

(76) Inventor: Burton Kozak, 1300 N. Lake Shore Dr., #28C, Chicago, IL (US) 60610

( * ) Notice: Subject to any disclaimer, the term of this patent is extended or adjusted under 35 U.S.C. 154(b) by 0 days.

(21) Appl. No.: 10/045,423

(22) Filed: Jan. 12, 2002

(65) Prior Publication Data

US 2003/0131695 A1 Jul. 17, 2003

(51) Int. Cl.[7] ..... B25B 23/00
(52) U.S. Cl. ..... 81/460; 81/441
(58) Field of Search ..... 81/460, 441, 436

(56) References Cited

U.S. PATENT DOCUMENTS 1,738,405 A * 12/1929 Thal ..... 81/441
1,741,349 A * 12/1929 Sullivan ..... 81/441
1,899,489 A * 2/1933 Wickbergh ..... 81/441
2,389,129 A * 11/1945 Bishop ..... 81/460
4,084,478 A * 4/1978 Simmons ..... 81/460
6,223,634 B1 * 5/2001 Hughes et al. ..... 81/460

* cited by examiner

*Primary Examiner*—D. S. Meislin
(74) *Attorney, Agent, or Firm*—Cherskov & Flaynik

(57) ABSTRACT

An anti-skip fastener tightening and/or extraction device 10 includes a tool bit end 12 having a plurality of flutes or crossing members 13–16, each crossing member having at least one recess 18 and 26 positioned in a side wall 20,21,28 and 29. The recesses 18 and 26 form edges 36 and 42 that engage corresponding portions of a fastener 17 to maintain engagement between the tool bit end 12 and the fastener 17 when forcibly rotating the fastener 17 to drive the fastener 17 into a workpiece or forcibly rotating the fastener 17 to extract the fastener 17 from a workpiece.

28 Claims, 9 Drawing Sheets

ANTI-SKIP FASTENER TIGHTENING AND/OR EXTRACTION DEVICE

BACKGROUND OF THE INVENTION

1. Field of the Invention

The present invention relates generally to fastener driver tool bits and, more particularly, to fastener driver tool bits that include features that prevent or reduce the tendency of a tool bit end to "skip" or "slide out" from the slots in fastener heads.

2. Background of the Prior Art

Screwdrivers, tool bit fastener drivers, Phillips screwdrivers and the like, when inserting or extracting a fastener from a workpiece, will at times "slip" or "skip" from the slot in the head of a fastener while imparting rotary motion to the fastener. Generally, the bit end of the fastener driver skips from the fastener after the fastener has been completely inserted into the workpiece, or when attempting to remove a corroded or relatively "old" fastener from the workpiece. When the tool bit skips from the fastener, the end of the bit has a tendency to tear away or wear down a portion of the side walls forming the slot in the head of the fastener. Repeated skips can deform the slot side walls such that the tool bit is incapable of imparting rotary motion to the fastener.

Prior art driver bits have attempted to correct the skipping problem by including relatively small recesses in the side walls of the flutes or crossing members that form the tip or drive portion of the bit. The recesses form edges that grip or "bite" into the side walls of the slot to promote rotary motion transfer between the driver bit and fastener. The recesses are machined in each side wall of each crossing member such that a right angle is formed between the recesses and the longitudinal axis of the bit when taking a side elevation view of the bit. Further, recesses are machined radially across the flutes to form multiple concentric arc segments when taking a drive end elevation view of the bit as disclosed in U.S. Pat. No. 4,998,454.

The problem with prior art driver bits that include recesses that grip the side walls of the slot of the fastener, is that there are an excessive number of recesses which structurally weaken the bits causing the bits to routinely break or deform when rotary motion sufficient to rotate the fastener, is imparted upon the bit from a rotary driver. A need exist for a driver bit that is capable of gripping the side walls that form the slot in the head of a fastener, and that is sufficiently strong to impart, without deforming or breaking, required rotary motion upon the fastener.

SUMMARY OF THE INVENTION

It is an object of the present invention to provide a screwdriver type tool bit that will not slide out from the slots (anti-skip) in a fastener when a rotary force is imposed upon the tool bit while inserting or extracting the fastener from a workpiece.

A principal object of the present invention is to provide an improved fastener driver that "grips" a side wall forming a slot in the head of the fastener. A feature of the improved fastener driver is one or more recesses in predetermined side walls of crossing members of a "Phillips type" screwdriver. An advantage of the improved fastener driver is that engagement between the driver and the fastener is maintained while the fastener is inserted into or extracted from a workpiece. Another advantage of the improved fastener driver is that constant rotary motion is imparted from the driver to the fastener when the fastener is inserted into or extracted from a workpiece.

Another object of the present invention is to provide gripping capability to a fastener driver while maintaining the structural strength of the driver. A feature of the improved fastener driver is one or more recesses forming edges that engage or "bite" into walls forming a driver receiving slot in a fastener. Another feature of the improved fastener driver is one or more recesses disposed in one of two side walls of each crossing member, the fastener driver being comprised of four crossing members. An advantage of the improved fastener driver is that the bit end of the driver maintains engagement with the fastener while imparting rotary force thereupon without bending or breaking the bit end.

Yet another object of the present invention is to provide a fastener driver having one or more recesses in side walls of the crossing members, the recesses being inclined relative to the longitudinal axis of the driver. A feature of the improved fastener driver is longer gripping edges formed by the inclined recesses. An advantage of the improved fastener driver is that gripping capability is increased without decreasing structural integrity.

Still another object of the present invention is to provide an improved blade type or "standard" fastener driver. A feature of the improved standard screwdriver is one or more recesses machined in opposing side walls of the screwdriver. An advantage of the improved standard screwdriver is that the screwdriver is capable of gripping a corresponding fastener thereby maintaining engagement between the screwdriver and fastener while the fastener is inserted into or extracted from a workpiece.

Another object of the present invention is to improve the gripping capability of a standard screwdriver while maintaining structural strength. A feature of the standard screwdriver is one or more recesses extending across a portion of each side wall forming the bit end of the screwdriver. An advantage of the standard screwdriver is that substantially the same amount of bitting edge from the partially extending recesses (compared to a recess extending totally across each side wall) engage the side walls forming the corresponding slot of the fastener thereby providing gripping capability and maintaining the quantity of rotational force that may be imparted from the screwdriver to the fastener.

Another object of the present invention is to improve the gripping capability of a Phillips screwdriver when inserted into relatively shallow receiving recesses disposed in a fastener. A feature of the screwdriver is one or more recesses disposed relatively close to the bit end. Another feature of the screwdriver is a crowned bit end formed from arcuate crossing members. An advantage of the screwdriver is that the entire edge of the recesses engage corresponding side walls of the recesses in the fastener to maximize gripping capability. Another advantage of the screwdriver is that the arcuate crossing members allow the crown portion of the bit end to engage a center portion of the fastener while the crossing members accommodate a foreign material built-up in the corners of the fastener recesses thereby promoting complete engagement between the edges of the recesses in the bit end and the walls of the recesses in the fastener.

Briefly, the invention provides an anti-skip fastener tightening and/or extraction device comprising a tool bit end having a plurality of crossing members, each crossing member having at least one recess positioned in a side wall, said recesses forming edges that engage corresponding portions of a fastener to maintain engagement between said tool bit end and the fastener when forcibly rotating the fastener to drive the fastener into a workpiece, said recesses forming edges that engage corresponding portions of the fastener to maintain engagement between said tool bit end and the fastener when forcibly rotating the fastener to extract the fastener from a workpiece.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
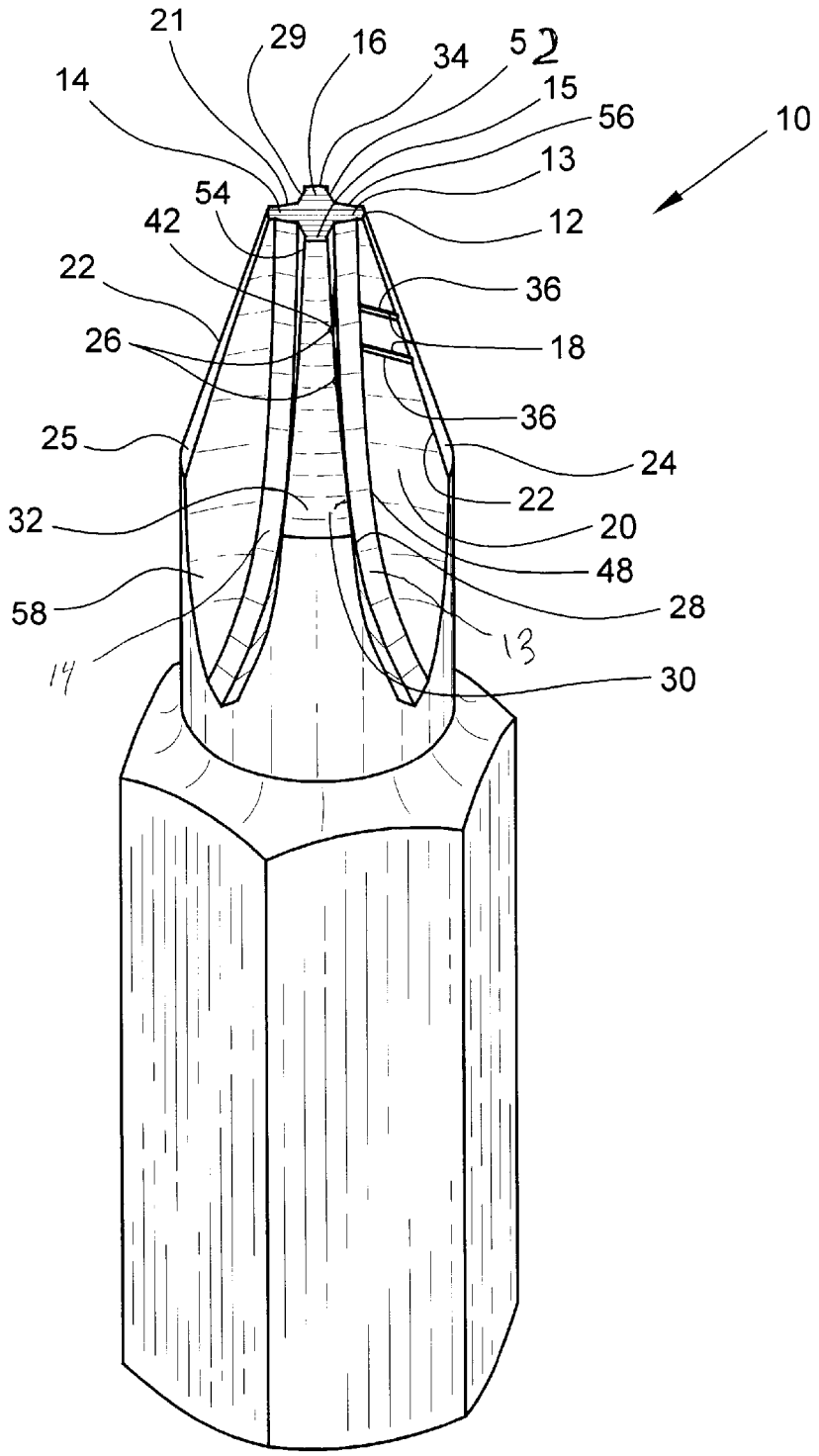
FIG. 1 is a perspective view of tool bit having recesses in a side wall in accordance with the present invention.
Figure 2:
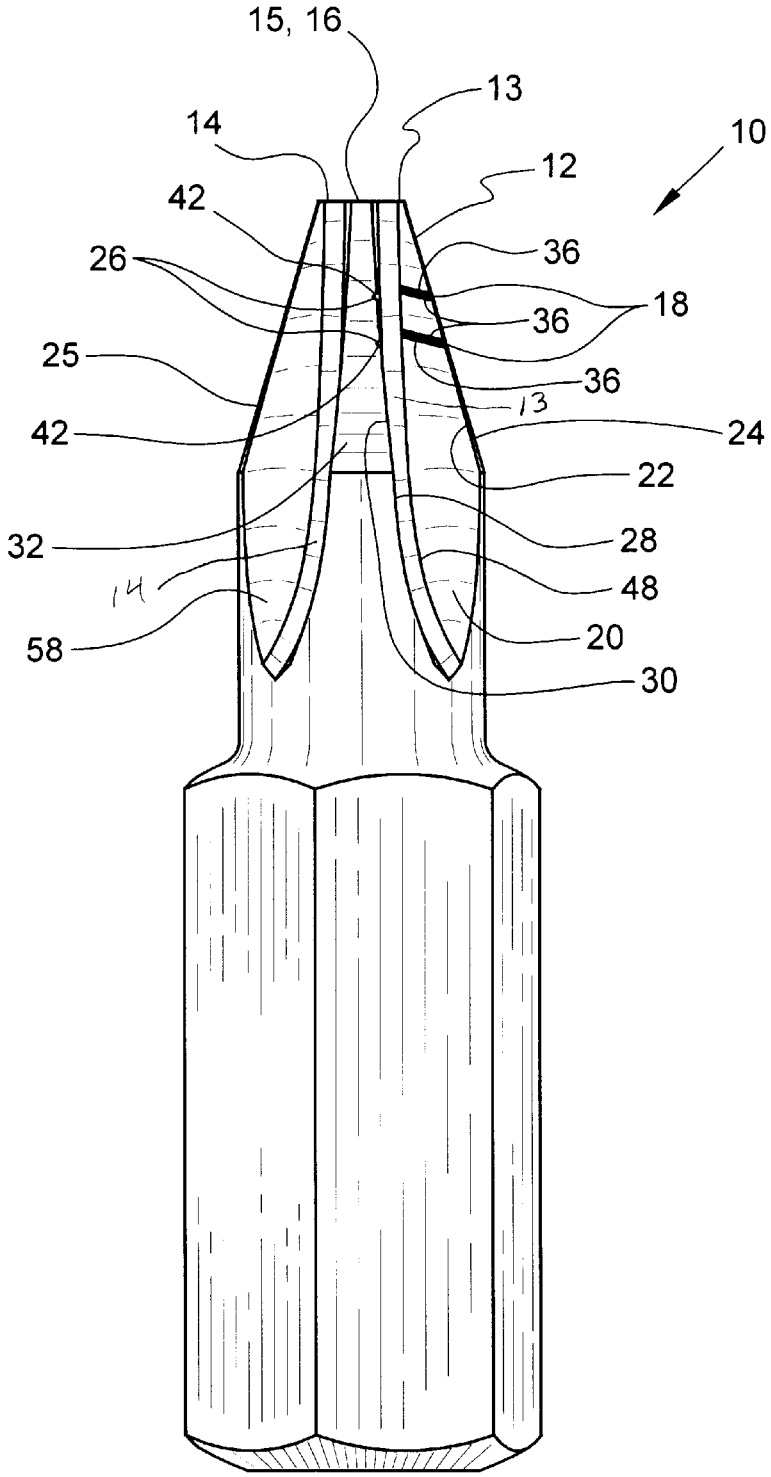
FIG. 2 is a front elevation view of the tool bit depicted in FIG. 1.
Figure 3:
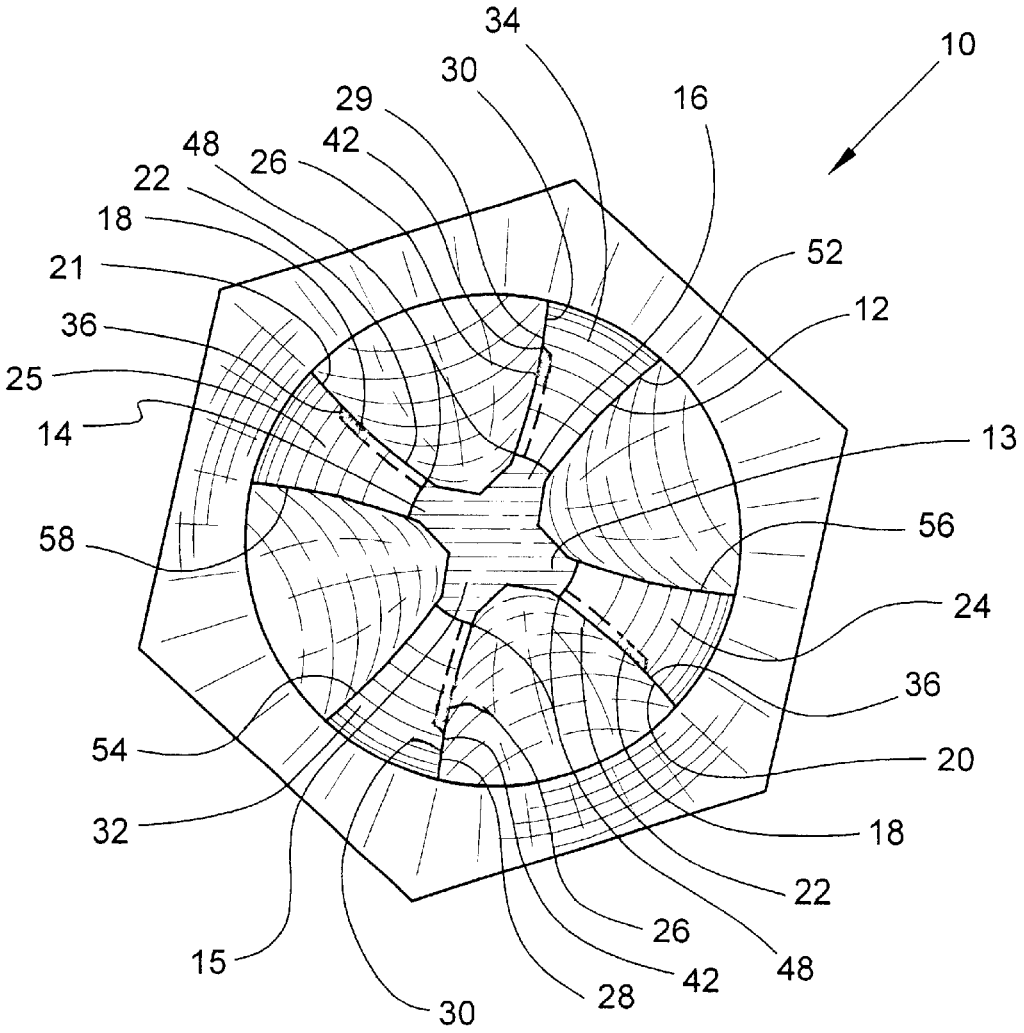
FIG. 3 is a top elevation view of the tool bit depicted in FIG. 1.
Figure 4:
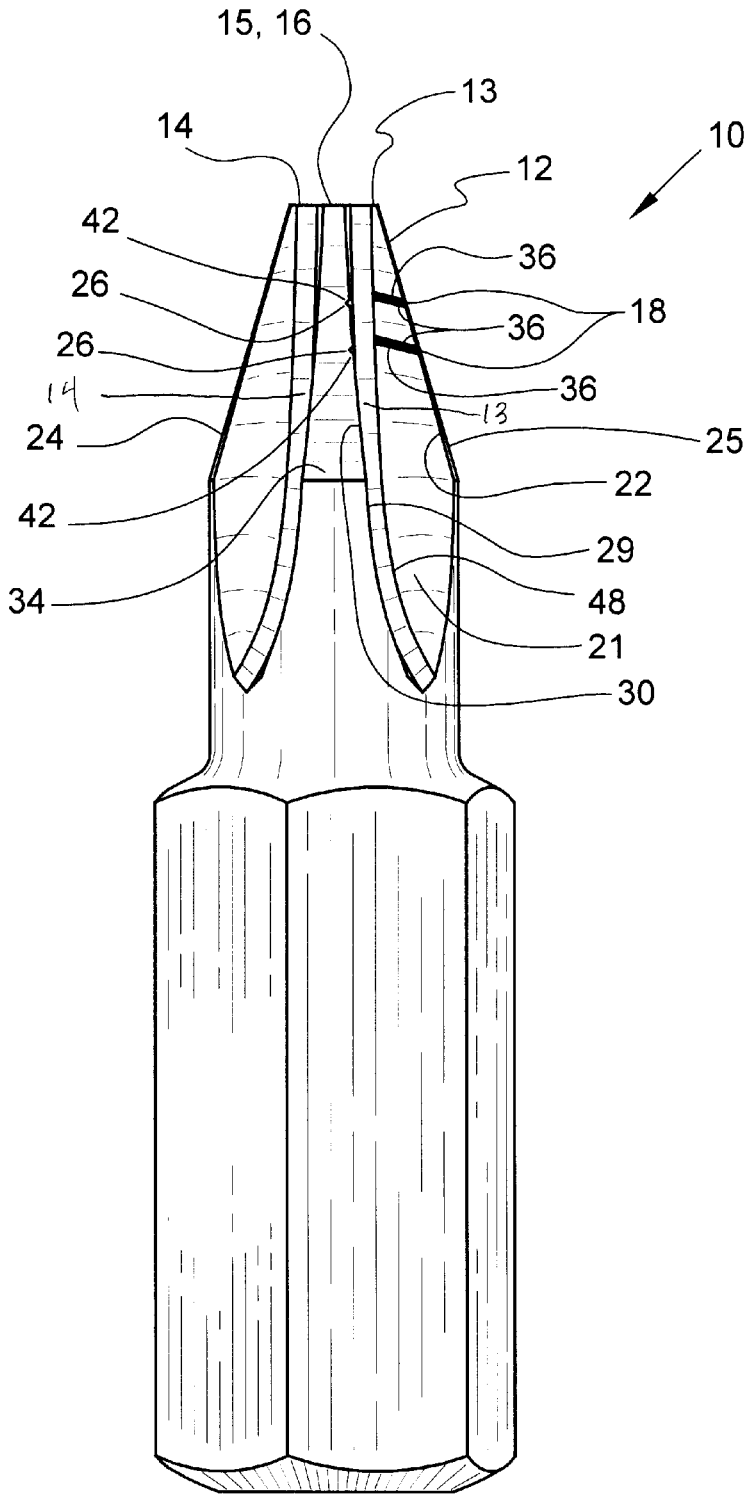
FIG. 4 is, a back elevation view of the tool bit depicted in FIG. 1.
Figure 5:
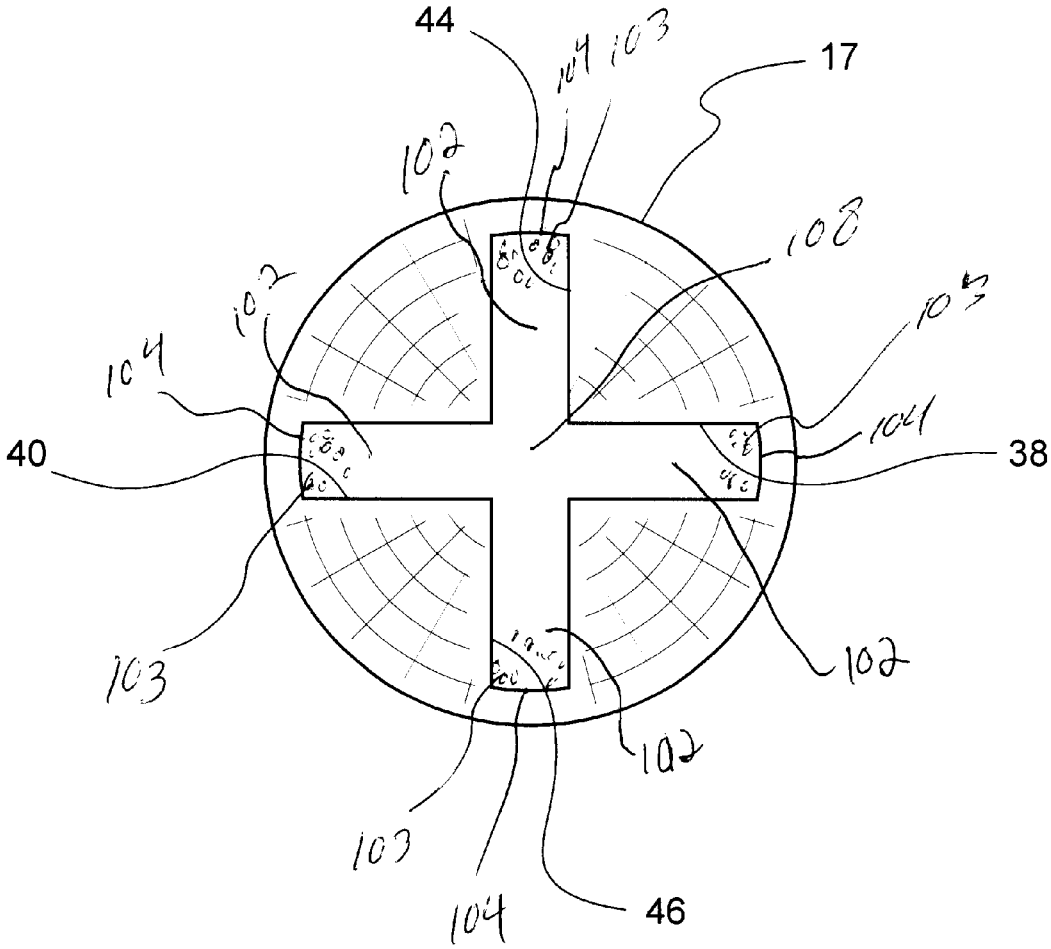
FIG. 5 is a top elevation view of a typical "Phillips type" fastener.

Referring now to FIGS. 1–5, an anti-skip fastener tightening and/or extraction device is denoted by numeral 10. The device 10 includes a tool bit end 12 having a cross configuration when taking an end view, and formed from four substantially identical crossing members 13, 14, 15 and 16 that are radially separated a substantially equal degree of arc thereby configuring a typical screwdriver bit for a standard cross or "Phillips" head fastener 17. Crossing members 13 and 14 have at least one, but preferably a plurality of parallel recesses 18 disposed in first side walls 20 and 21 such that an acute angle is formed (when taking a front elevation view of the device, see FIG. 2 ) between the recesses 18 and a mid-portion of an inclined edge 22 of first and second inclined walls 24 and 25 of members 13 and 14. Crossing members 15 and 16 have at least one, but preferably a plurality of parallel recesses 26 disposed in second side walls 28 and 29 such that an acute angle is formed (when taking a back elevation view of the device, see FIG. 4) between the recesses 26 and a mid-portion of an inclined edge 30 of first and second inclined walls 32 and 34 of the second crossing member 16.

The recesses 18 in first side walls 20 and 21 form edges 36 that engage and grasp the fastener 17 by "digging" into corresponding first side walls 38 and 40 of fastener 17 to maintain engagement between the tool bit end 12 and the fastener 17 when forcibly rotating the fastener 17 to drive the fastener 17 into a workpiece (not shown). The recesses 26 in the second side walls 28 and 29 form edges 42 that engage and grasp the fastener 17 by "digging" into corresponding second side walls 44 and 46 of fastener 17 to maintain engagement between the tool bit end 12 and the fastener 17 when forcibly rotating the fastener 17 to extract the fastener 17 from a workpiece. The recesses 18 and 26 are relatively narrow and substantially horizontal when taking front or back elevation views. The recesses 18 in the first side walls 20 and 21 extend across the first side walls 20 and 21 from an inner edge 48 to inclined edge 22 of corresponding inclined walls 24 and 25. The recesses 26 in the second side walls 28 and 29 extend across the second side walls 28 and 29 from an inner edge 48 to inclined edge 30 of corresponding inclined walls 32 and 34. The recesses 18 and 26 are separated a distance relatively larger than their lateral dimension and include a relatively shallow "depth" relative to the thickness of the crossing members 13–16 of the tool bit end 12.

Figure 6:
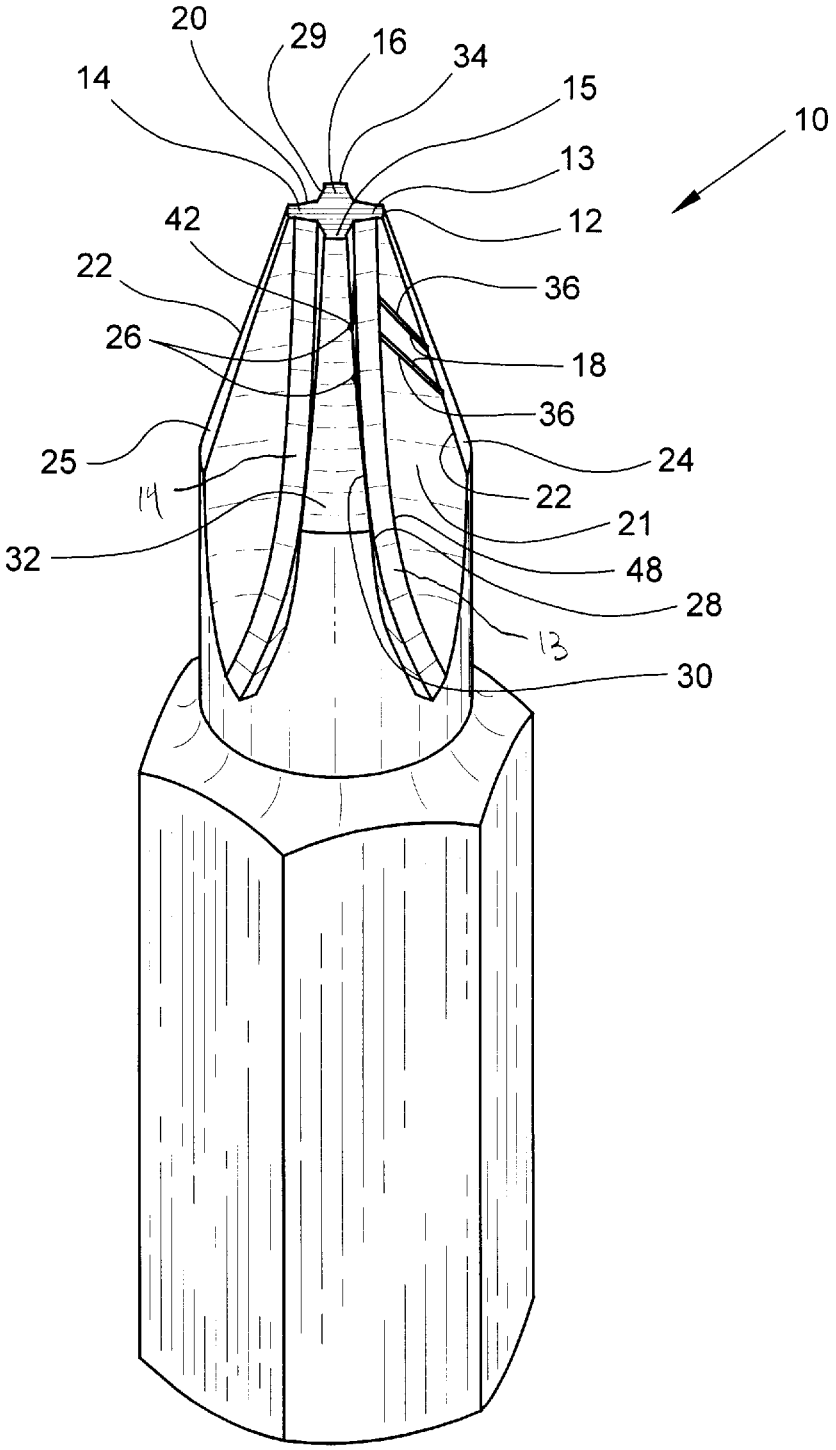
FIG. 6 is perspective view of an alternative embodiment of the tool bit depicted in FIG. 1 in accordance with the present invention.

The recesses 18 and 26 may be orientated perpendicular or parallel to the central axis of the tool bit and may be positioned at any portion of the first and second side walls 20, 21, 28 and 29 depending upon the size of the fastener 17 and the corresponding "depth" of the first and second side walls 38, 40, 44 and 46 into the fastener 17. Generally, the deeper the first and second side walls of the fastener 17, the greater the longitudinal dimension of the recesses 18 and 26 across the first and second side walls of the tool bit end 12. The longitudinal dimension is increased by angling the recesses 18 and 26 to a more vertical position extending from the inner edge 48 to inclined edges 22 and 30, respectively as depicted in FIG. 6. Further, the recesses 18 and 26 may vary in quantity from one to a plurality of recesses depending upon the desired "griping" capability of the device 10 upon the fastener 17.

Although the figures depict only the first side walls 20 and 21 of crossing members 13 and 14, and the second side walls 28 and 29 of crossing members 15 and 16 having recesses therein, all eight side walls of the tool bit end 12 may include recesses to improve the gripping capability of the device 10. More specifically, second side walls 56 and 58 of crossing members 13 and 14, respectively, and first side walls 54 and 52 of crossing members 15 and 16, respectively, may include recesses configured and disposed substantially identical to the recesses 18 and 26 in corresponding side walls. However, adding recesses in the tool bit end 12 weakens the metal forming the end 12 thereby reducing the amount of rotational force that can be applied to the device 10 without deforming the end 12. Positioning recesses in opposing side walls of the same crossing member such that bottom portions are directly opposite, further reduces the rotational force that may be applied. To minimize metal degradation, recesses in opposing side walls of a crossing member may be staggered whereby the quantity metal separating opposing lower portions of corresponding recesses is increased. Thus, keeping the quantity of recesses to a minimum while adding optimum gripping capability to the tool bit end 12 and/or avoiding recesses in opposite side walls of one of the crossing members 13–16 increases the amount of rotary force that may be imparted upon a fastener 17.

Alternatively, the tool bit end 12 may be designed to provide gripping capability in only one rotary direction. More specifically, the tool bit end 12 may be required to grip the fastener 17 to assemble a workpiece thereby requiring the recesses to grip the fastener 17 for insertion only. Recesses that are disposed to remove fasteners would not be included. Should the tool bit end 12 be required to only remove fasteners 17 from a workpiece, recesses that grip the fasteners 17 for extraction would be machined in the tool bit end 12, recesses that insert fasteners 17 would not be included.

In operation, a standard screwdriver bit 12 configured to insert or remove a Phillips head fastener 17 from a workpiece, is machined via techniques well known to those of ordinary skill in the art such that one or more recesses 18 are formed in the first side walls 20 and 21 of crossing members 13 and 14 for gripping the first side walls 38 and 40 of the fastener 17 during the extraction (counter-clockwise rotation) of the fastener 17 from a workpiece. Alternatively, one or more recesses 26 are machined in the second side walls 28 and 29 of crossing members 15 and 16 for gripping the second side walls 44 and 46 of the fastener 17 during the insertion (clockwise rotation) of the fastener 17 into the workpiece. Should the bit 12 be required to grip the fastener 17 for both extraction and insertion, recesses 18 and 26 would be machined in corresponding first and second side wall 20,21,28 and 29. Should a relatively small amount of rotary force be imparted upon the fastener 17 by the bit 12, and a relatively large gripping capability be required to insert and/or extract the fastener 17 from a workpiece, recesses 18 and/or 26 may be machined in corresponding first side walls 20,21,52 and 54 and/or second side walls 28,29,56 and 58 of the crossing members 13,14,15 and 16 (see FIGS. 1 and 3).

Figure 7:
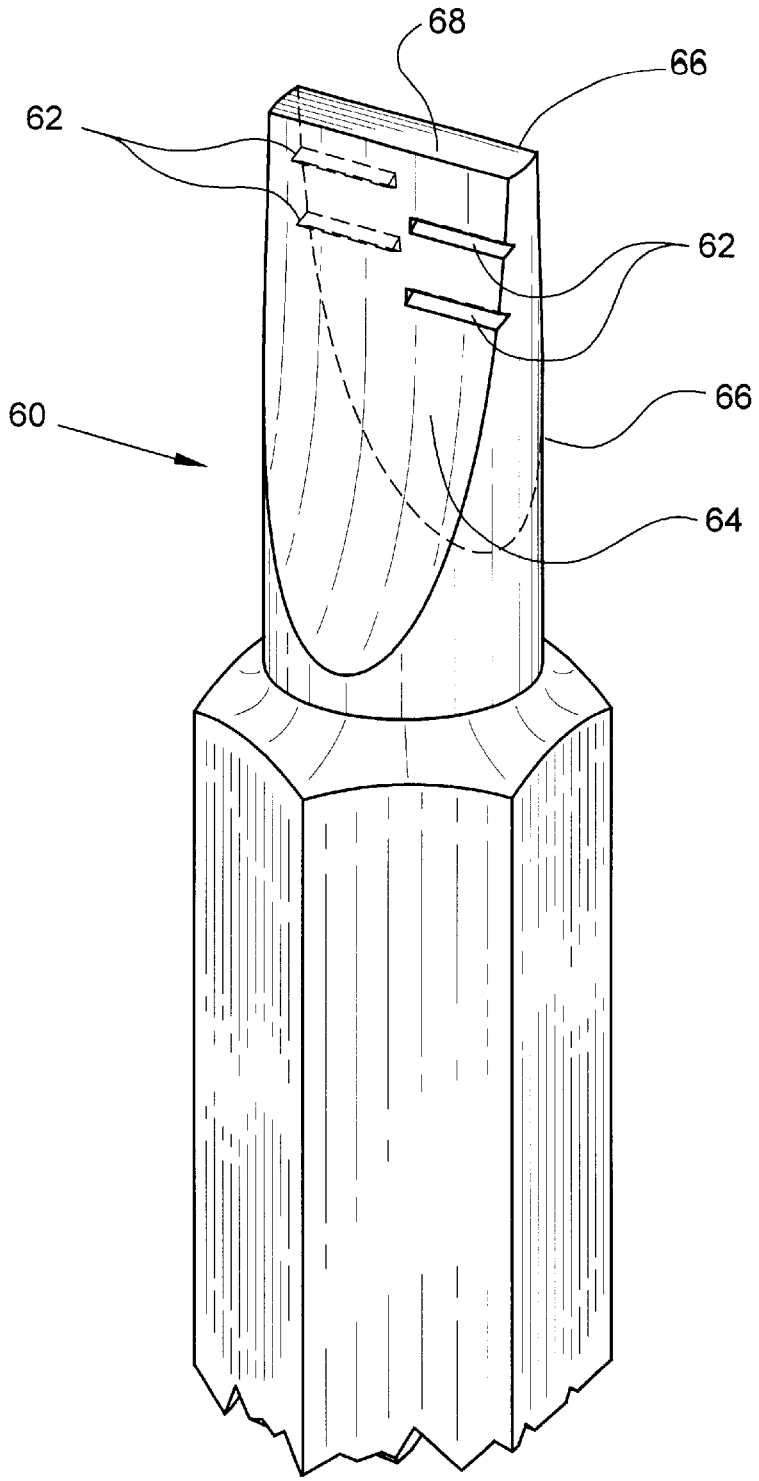
FIG. 7 is a perspective view of an alternative tool bit having recesses in a side wall in accordance with the present invention.

Referring now to FIG. 7, a standard "blade" screwdriver tip 60 is depicted having a plurality of recesses 62 machined in first and second sides 64 and 66 of the tip 60. The recesses 62 are parallel to the edge 68 of the tip 60, extend laterally across substantially half the tip 60, and include a "depth" relatively shallow in comparison to the "thickness" of the tip 60 thereby substantially maintaining the structural strength of the tip 60. The recesses 62 on each side 64 and 66 of the tip 60 are separated a distance relatively greater than the lateral dimension of the recesses 62. Machining recesses 62 across half the tip 60, maintains tip integrity but provides gripping capability in only one rotary direction. Extending the recesses 62 across the entire surface of the tip 60 would enable the tip 60 to grip the fastener in both rotary direction, but would decrease the structural strength of the tip 60 thereby reducing the amount of rotary force that may be imparted upon the screwdriver. Further, the recesses 62 may be inclined relative to the edge 68 or may be increased in quantity to increase the gripping capability of the tip 60, but resulting in a corresponding decrease in structural strength and the amount of rotational force that may be imparted from the tip 60 to the fastener. Staggering or varying the distances between the recesses 62 of the first side wall 64 and the edge 68 of the tip 60 relative to the distances between the recesses 62 of the second side wall 66 and the edge 68 of the tip, avoids "back-to-back" placement of the recesses 62, thereby substantially maintaining the structural integrity of the tip 60.

Figure 8:
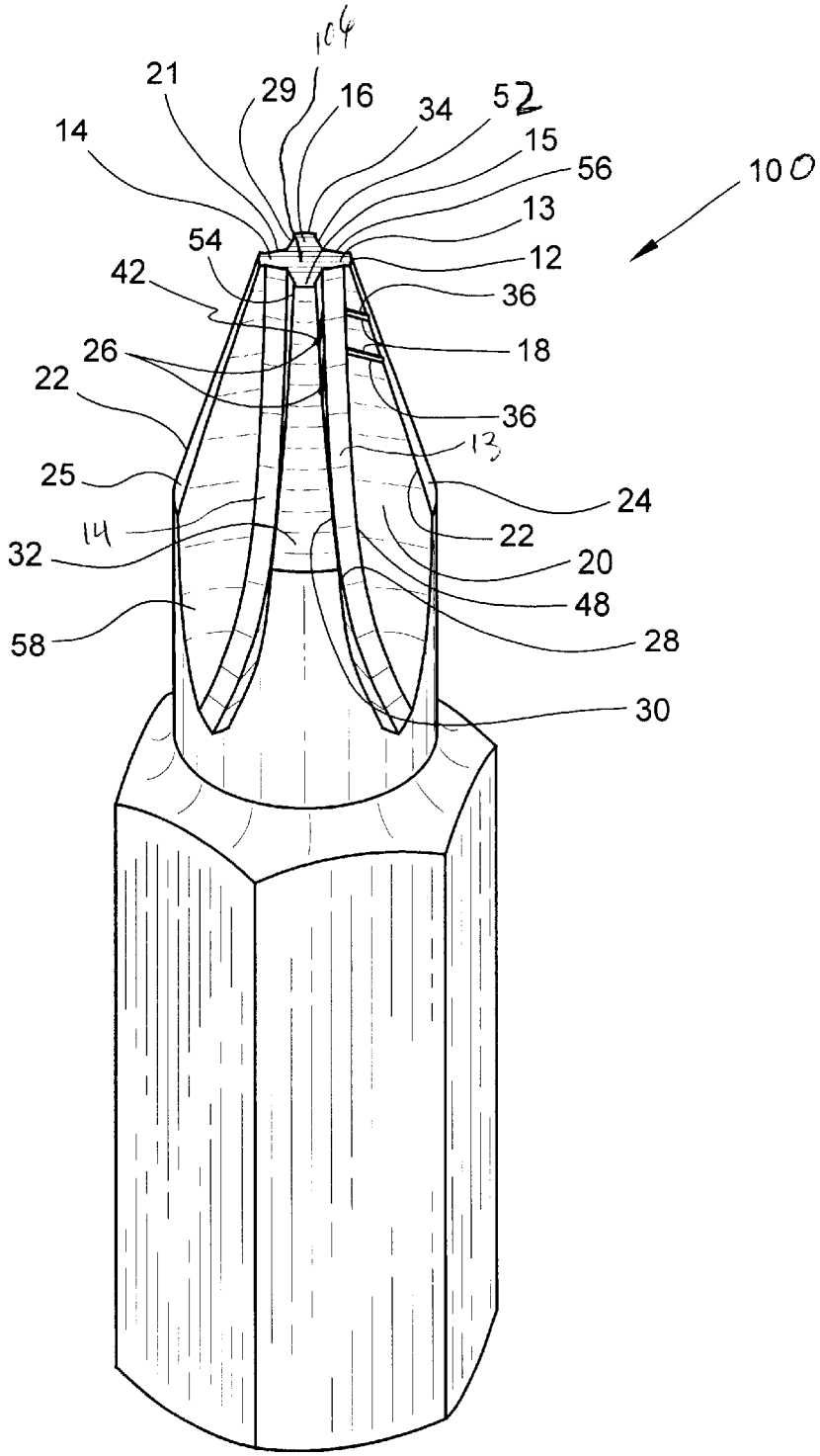
FIG. 8 is a perspective view of an alternative tool bit for a fastener with relatively shallow tool bit receiving recesses.
Figure 9:
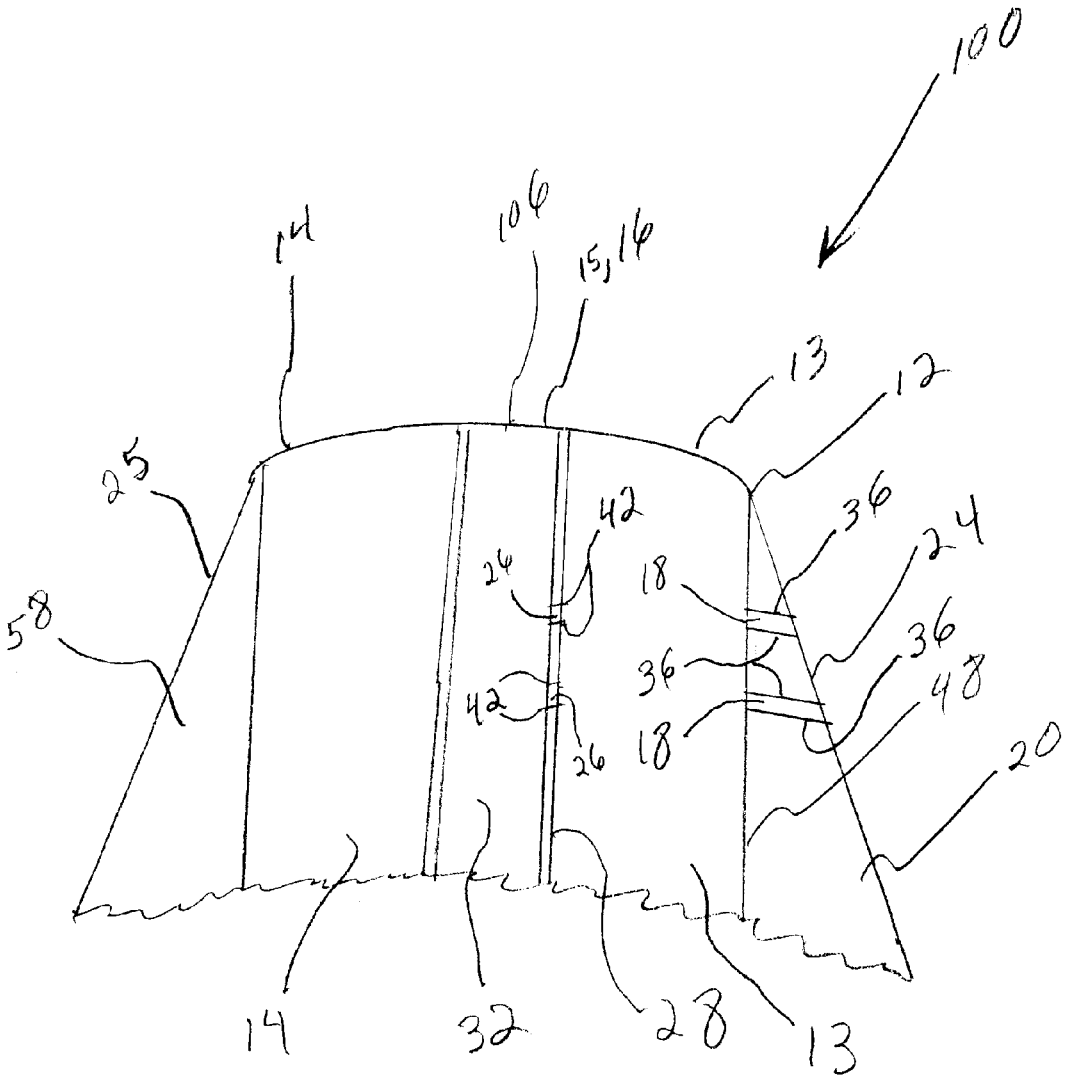
FIG. 9 is a side elevation view of the end of the alternative tool bit of FIG. 8.

Referring now to FIGS. 8 and 9, an alternative anti-skip fastener tightening and/or extraction device is denoted by numeral 100. The device 100 of FIG. 8 is substantially the same as the device 10 of FIG. 1 except that the recesses 18 and 26 in the alternative device 100 have been disposed closer to the tool bit end 12 to engage corresponding side walls 38, 40, 44 and 46 of a fastener 17 having relatively "shallow" recesses 102 that form the side walls 38, 40, 44 and 46. The device 100 further includes arcuate crossing members 13–16 that accommodate a slight grease, dirt and/or metal filing "buildup" 103 in corners 104 of the recesses 102 in the fastener 17. Thus, the device 100 is allowed to insert into the fastener 17 until a slightly crowned portion 106 of the device 100 engages a center portion 108 of the fastener 17, and the arcuate crossing members 13–16 engage and forcibly compress the grease and dirt buildup 103. The arcuate configuration facilitates total engagement and maximum "gripping" capability between the recess 18 and 26 of the device 100 and the side walls of a fastener 17 with shallow recesses 102 that have a foreign material buildup therein.

The foregoing description is for purposes of illustration only and is not intended to limit the scope of protection accorded this invention. The scope of protection is measured by the following claims, which should be interpreted as broadly as the inventive contribution permits.

What is claimed is:

1. An anti-skip fastener and/or extraction device comprising:

a tool bit end having a plurality of crossing members, each crossing member having at least one recess positioned in a predetermined side wall, said recesses forming edges that engage corresponding portions of a fastener to maintain engagement between said tool bit end and the fastener when forcibly rotating the fastener to drive the fastener into a workpiece or to extract the fastener from a workpiece, said crossing members include a first pair of opposite crossing member end portions having first side walls with at least one said recess therein and planar second side walls, said crossing members include a second pair of opposite crossing member end portions having planar first side walls and second side walls with at least one recess therein, said first side walls of said first pair of opposite crossing member end portions cooperating to extract a corresponding fastener, said second side walls of said second pair of opposite crossing member end portions cooperating to tighten a corresponding fastener whereby the gripping capability of the device is increased while substantially maintaining the structural integrity of tie fastener engagement end of the device.

2. The device of claim 1 wherein said first side walls of said first pair of opposite crossing member end portions include a plurality of recesses.

3. The device of claim 2 wherein said plurality of recesses are perpendicular to the central axis of the tool bit.

4. The device of claim 2 wherein said plurality of recesses form an acute angle with the central axis of the tool bit.

5. The device or claim 2 wherein said plurality of recesses are parallel to the central axis of the tool bit.

6. The device of claim 1 wherein said second side walls of said second pair of opposite crossing member end portions include a plurality of recesses.

7. The device of claim 6 wherein said plurality of recesses are perpendicular to the central axis of the tool bit.

8. The device of claim 6 wherein said plurality of recesses form an acute angle with the central axis of the tool bit.

9. The device of claim 6 wherein said plurality of recesses are parallel to the central axis of the tool bit.

10. An anti-skip fastener tightening and/or extraction device comprising:

a crowned tool bit end having a first pair of opposite crossing member end portions that include first side walls with at least one recess therein and planar second side walls, said crowned tool bit having a second pair of opposite crossing member end portions that include planar first side walls and second side walls with at least one recess therein, said recesses being configured to form edges that engage a portion of a side wall that forms a slot in a fastener to maintain engagement between said tool bit end and the fastener when forcibly rotating the fastener to drive the fastener into a workpiece or to extract the fastener from a workpiece, said first side walls of said first pair of opposite crossing member end portions cooperating to extract the fastener, said second side walls of said second pair of opposite crossing member end portions cooperating to tighten the fastener whereby the gripping capability of the device is increased while substantially maintaining the structural integrity of said fastener engagement end of said device.

11. The device of claim 10 wherein said recesses are configured to form a plurality of edges that engage a portion of the side walls of the fastener.

12. The device of claim 10 wherein said recesses are perpendicular to the central axis of said tool bit.

13. The device of claim 10 wherein said recesses form an acute angle with the central axis of said tool bit.

14. The device of claim 10 wherein said recesses are parallel to the central axis of said tool bit.

15. A method for providing an anti-skip fastener tightening and/or extraction device, said method comprising the steps of:

providing a fastener driver;

configuring at least one recess in first side walls of a first pair of opposite crossing member end portions, said first pair of crossing member end portions include planar second side walls; and configuring at least one recess in second side walls of a second pair of opposite crossing member end portions, said second pair of crossing member end portions include planar first side walls, said recesses in said first side walls forming edges that engage corresponding portions of a fastener to maintain engagement between said fastener driver and the fastener when forcibly rotating the fastener to extract the fastener from a workpiece, said recesses in said second side walls forming edges that engage corresponding portions of a fastener to maintain engagement between said fastener driver and the fastener when forcibly rotating the fastener to drive the fastener into a workpiece whereby the gripping capability of the device is increased while substantially maintaining the structural integrity of said fastener driver.

16. The method of claim 15 wherein said recesses are parallel to the central axis of said fastener driver.

17. The method of claim 15 wherein the step of providing a fastener driver having recesses includes the step of disposing said recesses to form an acute angle with the central axis of said fastener driver.

18. The method of claim 15 wherein the step of providing a fastener driver having recesses includes the step of providing a crowned tool bit end.

19. The method of claim 18 wherein the step of providing a crowned tool bit end having recesses includes the step of providing arcuate crossing members.

20. An anti-skip fastener insertion/extraction device comprising:

a fastener drive;

at least one recess disposed in opposite, radially aligned first side walls of opposite first pair of crossing member end portions, said first pair of crossing member end portions include planar second side walls; and at least one recess disposed in opposite, radially aligned second side walls of opposite second pair of crossing member end portions, said second pair of crossing member end portions include planar first side walls, said recesses in said first side walls forming edges that engage corresponding portions of a fastener to maintain engagement between said fastener driver and the fastener when forcibly rotating the fastener to extract the fastener from a workpiece, said recesses in said second side walls forming edge that engage corresponding portions of a fastener to maintain engagement between said fastener driver and the fastener when forcibly rotating the fastener to insert the fastener into a workpiece whereby the gripping capability of said device is increased while substantially maintaining the structural integrity of a fastener engagement end of said device.

21. The device of claim 20 wherein said recesses are disposed parallel to a longitudinal axis of said fastener driver.

22. The device of claim 20 wherein said recesses extend transverse to a longitudinal axis of said fastener driver.

23. The device of claim 20 wherein said recesses extend at an incline to a longitudinal axis of said fastener driver.

24. An anti-skip blade screwdriver comprising:

a fastener driver having opposite first and second walls, said first wall having a first portion with at least one recess therein, said first wall includes a second planar portion integrally joined and laterally disposed to said first portion, said second wall having a first planar portion opposite and integrally joined to said first portion of said first wall, said second wall includes a second portion with at least one recess therein, said second portion of said second wall being integrally joined and laterally disposed to said first planar portion of said second wall, said recesses forming edges for gripping corresponding portions of a fastener to maintain engagement between said blade screwdriver and fastener when forcibly rotating the fastener to insert or extract the fastener into or from a workpiece.

25. The device of claim 24 wherein said recesses extend across substantially half a tip portion of said fastener driver.

26. The device of claim 24 wherein said recesses are substantially parallel to a central axis of said fastener driver.

27. The device of claim 24 wherein said recesses in opposite side walls of a tip portion of said driver are disposed such that said recesses are not displaced the same distance from a drive end of said fastener driver.

28. The device of claim 24 wherein said recesses are inclined relative to a longitudinal axis of said fastener driver.

* * * * *

UNITED STATES PATENT AND TRADEMARK OFFICE

CERTIFICATE OF CORRECTION

PATENT NO. : 6,655,241 B2
DATED : December 2, 2003
INVENTOR(S) : Burton Kozak

It is certified that error appears in the above-identified patent and that said Letters Patent is hereby corrected as shown below:

Column 6,
Line 36, delete “tie” and substitute therefor -- the --.
Line 45, delete “or” and substitute therefor -- of --.
Line 48, after “said” insert -- first pair of opposite crossing members include a plurality of recesses, and said first side walls of said --.
Line 48, delete “member end por-” and substitute therefor -- members --.
Line 49, delete “tions”
Lines 59 and 62, delete “member end portions” and substitute therefor -- members --.
Line 66, after “fastener” delete the entirety of claim 10.

Signed and Sealed this

Twenty-eighth Day of September, 2004

JON W. DUDAS
*Director of the United States Patent and Trademark Office*